United States Patent [19]

Miyakawa et al.

[11] Patent Number: 5,005,025

[45] Date of Patent: Apr. 2, 1991

[54] PRINTER HAVING MEANS FOR HEATING A RECORDING SHEET AND FIXING INK THEREON

[75] Inventors: Akira Miyakawa, Tanashi; Hiroyuki Inoue, Chiba, both of Japan

[73] Assignee: Canon Kabushiki Kaisha, Tokyo, Japan

[21] Appl. No.: 566,311

[22] Filed: Aug. 13, 1990

Related U.S. Application Data

[63] Continuation of Ser. No. 202,568, Jun. 6, 1988, abandoned.

[30] Foreign Application Priority Data

Jun. 12, 1987 [JP] Japan ..... 62-146376
Jul. 7, 1987 [JP] Japan ..... 62-167827

[51] Int. Cl.[5] ..... B41V 2/01

[52] U.S. Cl. ..... 346/25; 101/424.1; 346/140 R

[58] Field of Search ..... 346/25, 140, 75; 101/424.1, 487, 488; 400/126, 645–645.5

[56] References Cited

U.S. PATENT DOCUMENTS 2,664,988 2/1954 Metzner et al. ..... 400/618
4,294,556 10/1981 Rix ..... 400/643
4,566,014 1/1986 Paranjpe ..... 346/1.1
4,774,523 9/1988 Beaufort ..... 346/25

FOREIGN PATENT DOCUMENTS 2717119 10/1977 Fed. Rep. of Germany .
56-56891 5/1981 Japan .
120447 7/1982 Japan .
58-82762 5/1983 Japan .
59-220385 12/1984 Japan .
61-32758 2/1986 Japan .
130863 6/1987 Japan .

*Primary Examiner*—Joseph W. Hartary
*Attorney, Agent, or Firm*—Fitzpatrick, Cella, Harper & Scinto

[57] ABSTRACT

An ink jet recording apparatus for recording by infiltrated ink into a recording sheet or by fixing ink through evaporation of an ink solvent includes an ink jet recording head for ejecting ink onto the recording sheet at a recording area of the apparatus where the recording head is opposed to the recording sheet. The apparatus also includes a heating member extending both upstream and downstream with respect to the recording area and a conveying direction of the recording sheet. The heating member contacts the recording sheet to assist in the fixation of the ink. The apparatus further includes a press plate, disposed upstream of the recording area with respect to a conveying route of the recording sheet, for pressing the recording sheet against the heating member. The press plate has a portion opposed to the heating member and a plurality of slits spaced apart from each in a direction perpendicular to the conveying direction of the recording sheet. The apparatus also includes a conveying member for discharging the recording sheet from the printer. The conveying member is provided downstream of the recording area with respect to the conveying direction. The heating member extends to a position opposed to the conveying member.

13 Claims, 6 Drawing Sheets

PRINTER HAVING MEANS FOR HEATING A RECORDING SHEET AND FIXING INK THEREON

This application is a continuation of application Ser. No 07/202,568 filed June 6, 1988, now abandoned.

BACKGROUND OF THE INVENTION

1. Field of the Invention

This invention relates to a recording apparatus which can solve various problems arising due to the existence of heat, and more particularly, it relates to a recording apparatus in which the heat must be considered, for example, such as an ink jet printer having a thermal fixing means.

2. Related Background Art

To date, ink jet printers have been advantageous in that there was no need to use a specific fixing means for recording paper.

However, recently, ink jet heads having rapid or prompt response features and microprocessors capable of performing high speed operations have been proposed, and high-density multi-orifice ink jet heads and longer ink jet heads have been developed in accordance with the progress of high accuracy and/ or super precision working techniques.

Consequently, the recording speed of the ink jet printer has rapidly been increased, and thus, some problems which were not regarded as important up to date have arisen.

In the ink jet printing system, liquid or molten ink drops are jetted onto a recording paper i.e., recording medium. The fixing of the ink on the recording medium is effected by the ink penetrating into the recording medium or by vaporizing the solvent in the ink (by means of a vaporizing process) to fix the ink pigment on the recording medium, thereby forming an image on the recording medium.

More specifically, the ink attached to the recording medium (normally, a plain paper) is fixed on the recording medium by the ink penetrating into the medium by capillarity and/or chemical bonding force, or by leaving the ink pigment or ink dyes on the recording medium by evaporating the solvent in the ink liquid.

However, in these cases, the fixing speed depends upon not only the configuration and physical features of the recording medium but also upon the surrounding atmosphere. Further, the time when the ink is naturally or unartificially fixed on the recording medium cannot be reduced beyond a certain limit due to the physical properties of the ink and medium.

Therefore, in recent high speed printing operations, there has arisen the problem that the recording medium was ejected before the fixing of the ink was completed. In such a case, the printer or an operator's finger is smudged with unfixed ink, or the back of the next recording paper is smudged with unfixed ink on the previous recording medium, or an image of high quality cannot be obtained due to the flow of unfixed ink on the recording medium.

In order to prevent the worsening of the recording quality due to such imperfect fixing, for example, a special recording medium (such as coated paper and the like) having an absorbable coating layer thereon has been used to shorten or decrease the fixing time. In this case, however, the important advantage that plain paper can be used in the ink jet printing system is lost, and a new problem that the use of the special recording paper prevents the wide development of ink jet printing system arises.

On the other hand, a technique in which the fixing means includes a heating means for heating the recording medium so as to decrease the fixing time has also been proposed.

For example, West German Patent Laid-Open Patent No. 2,717,119 discloses a technique in which the thermal fixing is effected by heating a recorded recording sheet by means of a flat heater. With this technique, the fixing efficiencY is improved; however, this proposed technique is still insufficient. That is to say, in this proposed technique, the heated surface (i.e., the back) of the recording sheet tends to shrink, thereby curling the recording sheet. Further, since the front surface of the recording sheet is supplied with ink liquid by means of the ink jet head, the front surface of the recording sheet tends to expand due to moisture of the ink, thus increasing the curl of the recording sheet.

If the recording sheet is so curled, the efficiency of heat transmission to the recording sheet is considerably decreased; thus, in order to obtain the desired fixing, the caloric value or heating value of the heater must be increased. However, the increased caloric value not only increases the consumption of energy, but also tends to dry the ink jet head, thus jamming orifices of the ink jet head. Nevertheless, there was room to improve the efficiency of the heating and/or to obtain a compact construction of the ink jet printer.

Further, in recording apparatuses such as ink jet printers and wire dot printers, the distance between a recording head and a recording sheet (referred to as "head gap" hereinafter) must be relatively severely controlled. If the head gap is not maintained properly, in case of the wire dot printer, since impact force cannot be maintained uniformly in the printing cycles, there arises a difference in density between the printed images, and in case of the ink jet printer, deflected ink dots are recorded on the recording sheet. Further, if the recording sheet contacts the printing head, the surface to be recorded (of the recording sheet) will be smudged.

Therefore, normally, in a recording apparatus, as shown in FIG. 10, a recording sheet 103 wound around a platen 101 and being fed to a recording position by means of the platen and pinch rollers 102 is pressed against the platen 101 just ahead of a recording head 104 by means of a sheet holding plate 105. More particularly, by pressing the recording sheet 103 against the platen 101 tangential thereto with uniform force by means of the sheet holding plate 105 the recording sheet 103 is maintained parallel to a face of the recording head 104, thus ensuring a proper head gap.

Further, in the recent printer market, there has been a tendency that special use printers have been modified to function as general use printers (that is, a tendency that the printer is popularized); for example, a printer which can print or record characters on any recording sheet has been requested. In this regard, since the wire dot printer is an impact-type printer, it can easily record the characters or images even on a plain paper; however, in case of the ink jet printer, since the ink is used as a printing medium, there was a problem of the fixing of ink on the recording sheet. Thus, it has been considered that in the ink jet printer plain paper could not be used since it was difficult to fix the ink on recording sheets other than special sheets.

However, recently, various methods and systems for fixing the ink on the recording sheet have been proposed. Among them, as a fixing apparatus having a relatively simple and compact construction, an evaporating fixing apparatus which includes a heater arranged inside a platen roller or arranged in a paper path other than that associated with rollers and wherein the fixing is effected by heating a recorded surface of the recording sheet by means of the heater to evaporate the moisture in the ink has been put to practical use. For example, in an apparatus shown in FIG. 11, a heater 106 is arranged inside a platen 101 and a recording sheet 103 fed by pinch rollers 102 is heated adequately before it reaches a recording head 104. Alternatively, in an apparatus shown in FIG. 12, a heater 108 is arranged behind a heating plate 107 which also acts as a flat platen. A recording sheet 103 fed by pinch rollers 102 is pressed against the platen roller 101 by a sheet holding plate 105 and then is fed to the heating plate 107, where the ink drops jetted onto the recording paper are vaporized to fix the ink dyes on the sheet However, in the above-mentioned printers having a heater, it is, of course, necessary to provide a sheet holding plate. In these printers, since the heat is transmitted from the heated recording sheet to the sheet holding plate, the sheet holding plate is deflected, as shown in FIG. 13, due to the difference in thermal strain derived from uneven temperature distribution on the sheet holding plate. More particularly, in FIG. 13 showing a printer having a carriage 110 and a heater (not shown) incorporated into a platen 101, a recording sheet 103 introduced into the printer along a sheet guide 109 is heated by the heater in the platen 101. Further, the recording sheet 103 is pressed against the platen 101 by means of a sheet holding plate 105. In this connection, since an edge 105A of the sheet holding plate 105 is in contact with the heated recording sheet 103, the edge portion 105A of the sheet holding plate is locally heated; whereas the remaining portion of the sheet holding plate is not so heated as the edge portion, since the heat transmitted to said remaining portion is dispersed through a frame 111 by which the sheet holding plate 105 is supported. Consequently, corrugated deflection as shown in FIG. 13 is created on the edge portion 105A of the sheet holding plate.

In such circumstances, the recording sheet 103 cannot uniformly be pressed against the platen 101 due to the deflection of the sheet holding plate, with the result that the recording sheet floats partly above the platen, thereby causing disorder of the recorded image, oblique movement of the recording sheet and the like; further, in this case, if the recording sheet 103 contacts the recording head, the sheet will be smudged with ink. Of course, such condition has an undesirable appearance and causes functional defects.

SUMMARY OF THE INVENTION

Accordingly, an object of the present invention is to provide a recording apparatus which can solve various problems arising due to the existence of heat.

Another object of the present invention is to provide a recording apparatus which achieves high fixing efficiency and can eliminate the smudge of the recording sheet and the jamming of the nozzles in the printing head.

It is a further object of the present invention is to provide a recording apparatus in which the sheet holding plate is not deflected or distorted.

These and other objects will be apparent from the explanation provided hereinbelow.

BRIEF DESCRIPTION OF THE DRAWINGS

FIGS. 1 to 9 show embodiments of the present invention, wherein,

FIG. 1 is a perspective view of a recording apparatus according to a first embodiment of the present invention;

FIG. 2 is a cross sectional end view of the recording apparatus of FIG. 1;

FIG. 3 is a sectional end view of a recording apparatus according to a second embodiment of the present invention;

FIG. 4 is a sectional end view of a recording apparatus according to a third embodiment of the present invention;

FIG. 5 is a sectional end view of a recording apparatus according to a fourth embodiment of the present invention;

FIG. 6 is a sectional end view of a recording apparatus according to a fifth embodiment of the present invention;

FIG. 7 is a perspective view of a recording apparatus according to a sixth embodiment of the present invention;

FIG. 8 is a plan view of a sheet holding plate of a recording apparatus according to a seventh embodiment of the present invention;

FIGS. 10 to 13 shows conventional recording apparatuses, wherein,

FIG. 10 is an end view of a conventional recording apparatus;

FIG. 11 is a sectional end view of another conventional recording apparatus;

FIG. 12 is a sectional end view of a further conventional recording apparatus; and FIG. 13 is a perspective view of a further conventional recording apparatus.

DETAILED DESCRIPTION OF THE PREFERRED EMBODIMENTS

The present invention will now be explained with reference to the illustrated embodiments.

Figure 1:
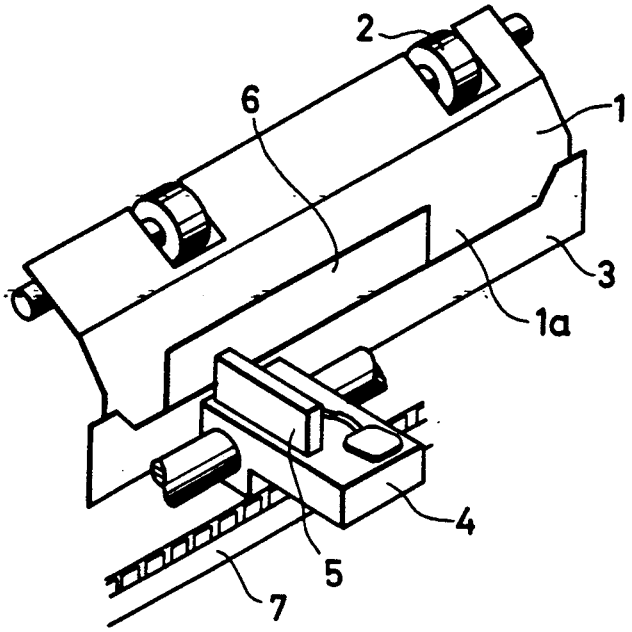

FIG. 1 is a schematic perspective view of an ink jet printer according to a first embodiment of the present invention. The printer includes a fixing means (heating means) 1 comprising a heating portion, a planar surface 1*a* which constitutes platen, discharging rollers 2, a paper (recording medium 6) holding member 3, a carriage 4, a recording head 5, and a driving belt 7 for shifting the carriage.

Figure 2:
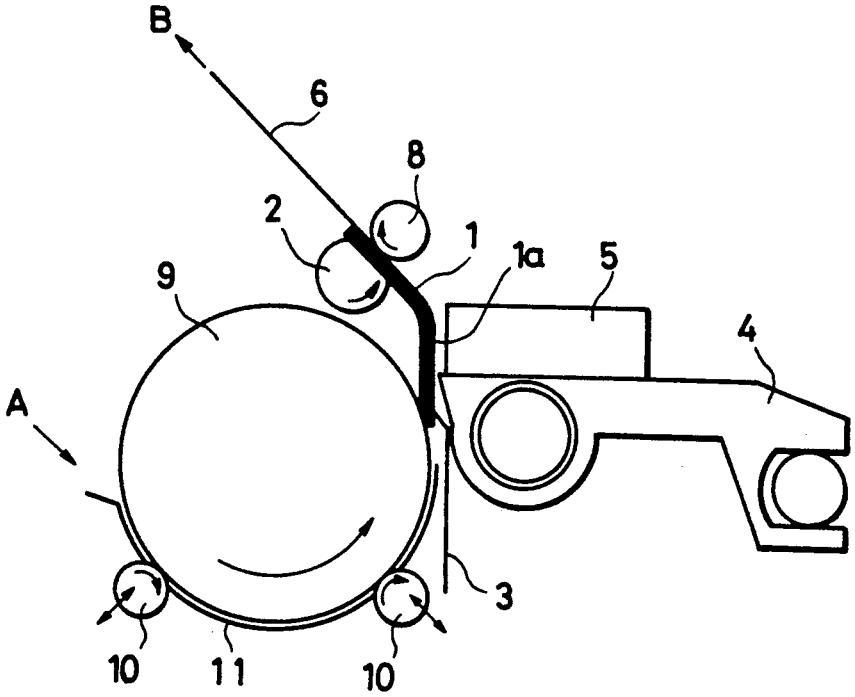

With reference to FIG. 2 showing a schematic sectional end view of the ink jet printer of FIG. 1, the printer further includes bail rollers 8, a friction roller 9, pinch rollers 10 and a paper (recording medium) guide 11.

In the illustrated embodiment, the recording medium 6 fed from a direction shown by an arrow A is introduced between the paper guide 11 and the friction roller 9 and is conveyed, by means of the pinch rollers 10, to a recording portion situated in front of the recording head 5. After the recording is effected on the recording medium, the recording medium is directed between the discharging rollers 2 and the bail rollers 8 and then is discharged from the printer.

Further, in the illustrated embodiment, while the recording medium 6 left from the friction roller 9 passes through the fixing means 1 which extends from an area including a plane opposed to the recording head to the discharging rollers 2, the recording medium is heated by the fixing means and then is discharged from the printer.

In the illustrated embodiment, by extending the fixing means 1 up to an area to which the discharging rollers 2 belong, it is possible to ensure adequate fixing, while maintaining a short transporting path for the recording medium, and in particular, a short discharging path.

More specifically, if the transporting path for the recording medium is shortened or decreased so that it is smaller than that of the conventional ink jet printer, the effective length of the fixing means will inevitably be shortened. On the other hand, if the fixing means cannot provide a fixing time sufficient to perform a desired fixing due to the insufficient effective length thereof, there will be no meaning in the provision of the fixing means. Thus, in the illustrated embodiment, the fixing means 1 is extended up to the area to which the discharging rollers 2 belong, so that the required effective length of the fixing means is obtained.

Consequently, in this embodiment, it is possible to perform an adequate or complete fixing, to obtain a compact construction, and to obtain a recorded image of high quality regardless of circumferential environment.

If the fixing means comprises a heat source, the feature of the fixing depends upon the temperature of the fixing means and the fixing time (the time when the recorded paper is moving on the fixing means). For example, if the temperature of the fixing means is increased, the fixing time may be decreased accordingly. However, if the temperature of the fixing means is too high, the recording medium contacting the fixing means will be curled; thus, in this case, a straightener for flattening the curled recording medium must be provided. In order to avoid the provision of the straightener, the apparatus should be designed so that the paper path (i.e., the transporting path for the recording medium) is so curved as not to apply undesirable stress to the recording medium in the paper path. In this connection, in the illustrated embodiment, the fixing means 1 has an intermediate bent portion of a predetermined curvature. The temperature of the fixing means is preferably in the range of 30°-150° C., including the temperature when the recording medium is applied to special use, and, in general, is in the range of 40°-100° C. When an upper limit of the fixing temperature is suitably selected, the required length of the heater (i.e., an effective length of the fixing means) can naturally been determined. For example, when a water-based (water soluble) ink is used, it was found that if the temperature of the heater was selected to 60° C., 80° C. and 100° C., respectively, the required fixing time was 5 sec, 3 sec and 2 sec, respectively. This shows that the higher temperature of the fixing means is preferable to a decrease in the fixing time. On the other hand, the lower temperature of the fixing means is desirable to decrease the running cost including electric power to be consumed, and to achieve a compact construction and a low price of the recording apparatus due to the use of a small-sized power unit.

In order to satisfy the above requirements, in the illustrated embodiment, the discharging or ejecting rollers 2 are arranged to overlap a portion of the fixing means. With this arrangement, it is possible to lengthen the fixing means without extending the paper path.

Figure 3:
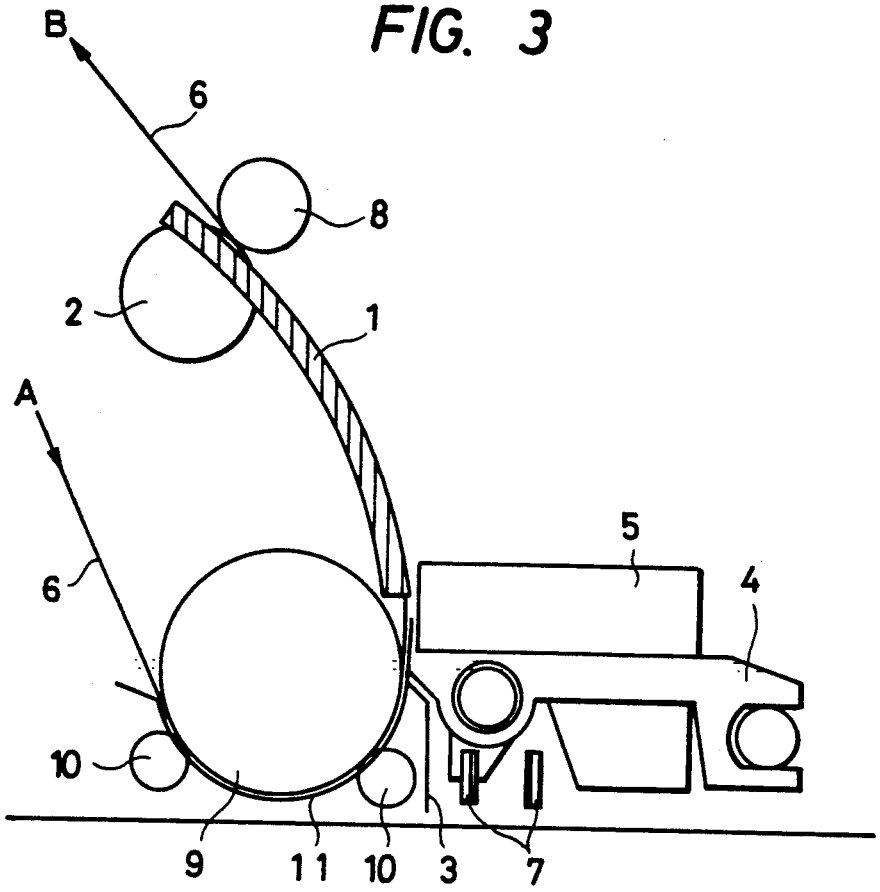

Next, a second embodiment of the present invention in which the contact between the recording paper and the fixing means is improved to effect more effective fixing will be explained with reference to a sectional end view of the recording apparatus shown in FIG. 3. In this embodiment, as shown in FIG. 3, the fixing means 1 has an easy or gentle curvature through the whole length thereof to provide a gentle paper path. With this construction, the contact between the fixing means 1 and the recording medium 6 is improved, with the result that the heat transmission from the fixing means to the recording medium is also improved, whereby a shorter fixing means can be used with the same fixing temperature.

Incidentally, in this second embodiment, since the fixing means (heating means) 1 extends up to the ejecting or discharging rollers 2, the temperature in the vicinity of the ejecting rollers 2 is increased. Thus, the ejecting rollers 2 are preferably formed by heat resisting material (for example, such as I.R, C.R rubber or norbornene polymer) in place of conventional roller material (for example, Urethan). By constructing the ejecting rollers 2 with the heat resisting and wear resisting material having a high coefficient of friction, the ejecting rollers 2 can be positioned nearer the fixing means, thus permitting more compact construction of the recording apparatus.

Figure 4:
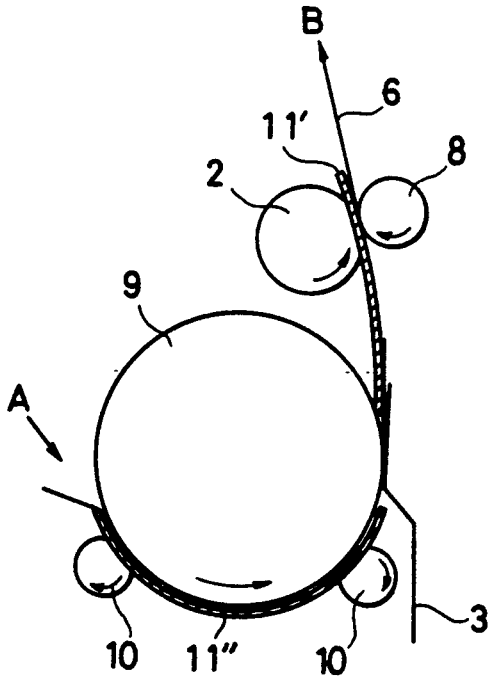

In the above-mentioned embodiments, the recording apparatus having a single fixing means has been explained. However, considering the thermal or heating efficiency, the cost, the electric power to be consumed and fixing efficiency, as shown in a third embodiment of FIG. 4, the recording apparatus may include a first fixing means 11' extending from the recording area to the ejecting rollers 2 and may utilize a paper guide 11" itself as a second fixing means. Of course, the position of these fixing means may be determined synthetically on the basis of the fixing efficiency and the like; therefore, the position and configuration of the fixing means are not limited to the illustrated ones.

Figure 5:
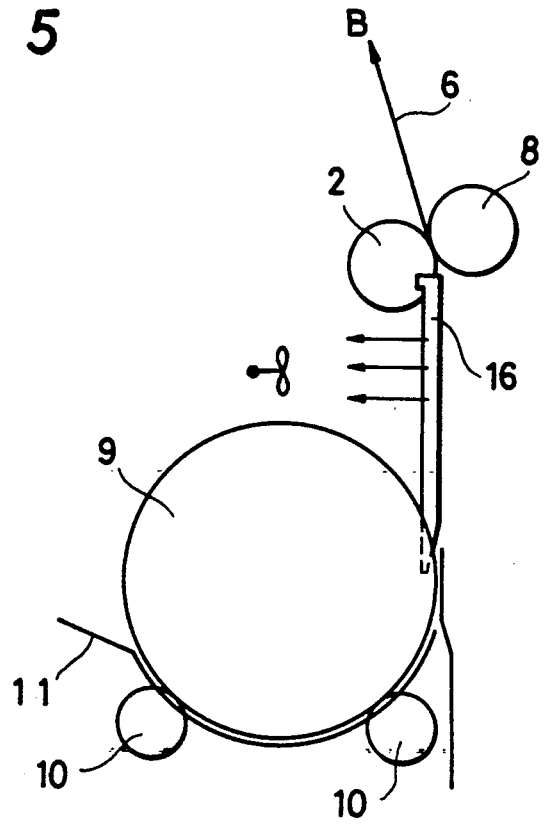

Further, in the above-mentioned embodiments, as explained above, fixing is effected by evaporating the solvent in the ink by means of the heater incorporated in the fixing means. However, as shown in a fourth embodiment of FIG. 5, a suction force may apply to the back of the recording medium 6. In this case, the fixing efficiency can be improved by penetrating the ink into the recording medium 6 more rapidly by means of the suction force, as well as by heating the recording medium by means of the heater, and the fixing time can be reduced by promoting the evaporation of the ink solvent due to the agitation of surrounding atmosphere by means of the suction force. Further, in this case, the advantage that the recording medium 6 positively contacts the fixing means (that is, the floating of the recording medium from the fixing means can be positively prevented) can also be obtained. In this fourth embodiment, the fixing means comprises a porous platen 16 having the heater (not shown) therein, and the suction force is created by an appropriate negative pressure source or suction source (not shown).

Figure 6:
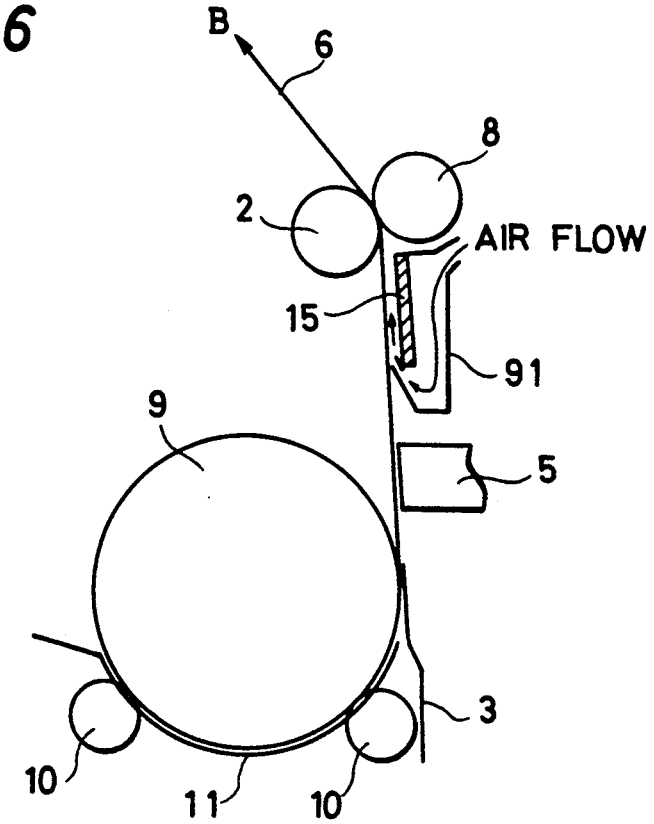

Further, as shown in a fifth embodiment of FIG. 6, the fixing efficiency may be improved by providing a heater 15 behind a fixing means 91 and by forming an air passage in the heater so as to supply the heated air onto the recording medium. In this case, the heated air may be directed in a direction in which the recording medium is moved so that the heated air is not directly applied to the ink jet head. Further, also in this case, the floating of the recording medium can be prevented. With this construction, the fixing efficiency is remarkably improved by radiation from the fixing means 91 and the heated air from the heater 15.

Next, embodiments of the present invention which can effectively solve the problem of the thermal deflection or distortion of the sheet holding plate, among the various problems arising due to the existence of heat will be explained.

Figure 7:
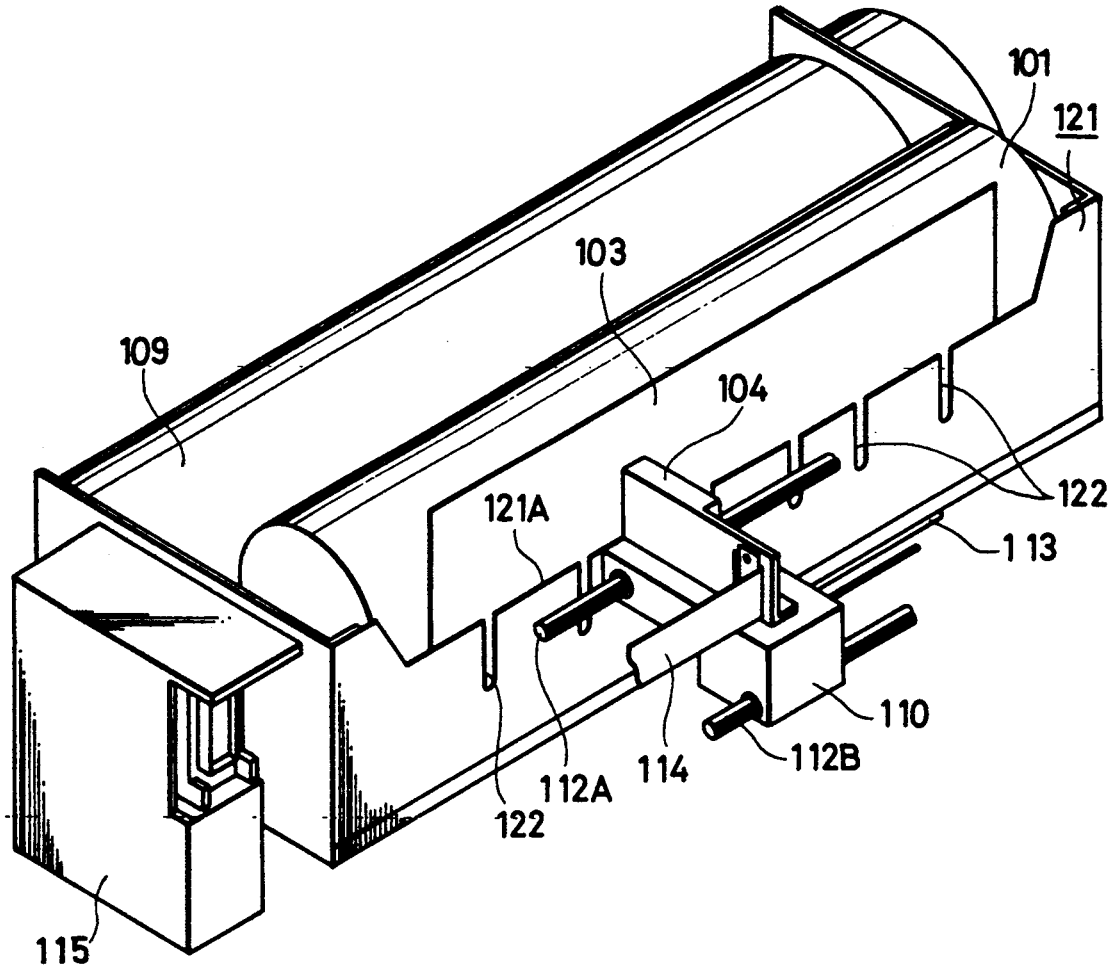

FIG. 7 shows a sixth embodiment of the present invention. In this embodiment, the recording apparatus includes a platen roller 101 incorporating a heater (not shown) therein, a recording head 104 carried by a carriage 110 which can be shifted along a pair of guide shafts 112A and 112B by means of an appropriate driving means (not shown), an ink supplying conduit 113, a flexible cable 114 for applying an ink jetting signal to the recording head 104, and a restoring device 115 for preventing the jamming of nozzles in the recording head 104 to ensure a correct ink jetting operation. A sheet holding plate 121 of the recording apparatus of this embodiment has an edge portion 121A which is pressed against the platen roller 101. The edge portion 105A has a plurality of parallel notches or slots 122. The depth of each slot 122 and the distance between the adjacent slots may be suitably selected. For example, the distance between the adjacent slots 122 may be reduced if a large amount of heat is transmitted to the edge portion 121A of the sheet holding plate 121 due to the higher temperature of the heater. Further, the depth of each slot 122 may be adjusted to obtain an optimum spring rate of the sheet holding plate 121. Preferably, the depth of the slot is smaller than half the width (the length of the plate measured in a direction that the slot extends) of the sheet holding plate.

With such a construction of the sheet holding plate 121, since the heat transmitted to the edge portion 121A is dispersed through the slots 122 and the slots can compensate or absorb thermal expansion in a longitudinal direction of the sheet holding plate 121, the edge portion 121A is not deflected even if the thermal strain is generated thereon, thus maintaining the good contact of the recording medium 103 against the platen 101.

Figure 8:
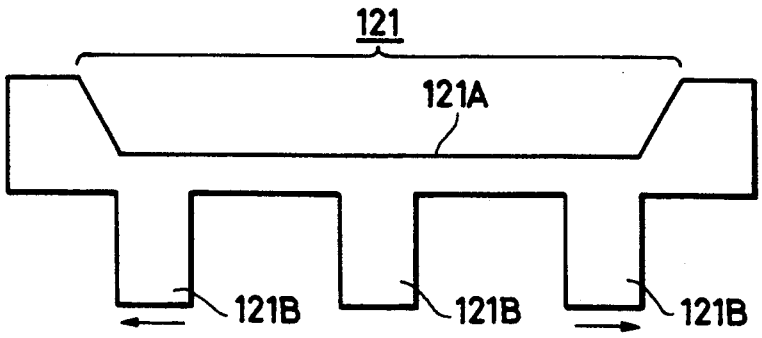

FIGS. 8 to 13 show other embodiments of the present invention. FIG. 8 shows a seventh embodiment of the present invention, wherein a sheet holding plate 121 has a recessed upper portion including an edge 121A which contacts with the platen roller (not shown) and a slotted or notched lower portion. In this embodiment, a central tongue 121B formed in the lower portion of the sheet holding plate 121 is suitably fixed, but the other tongues (side tongues) 121B can be moved laterally in appropriate slots (not shown).

Figure 9A:
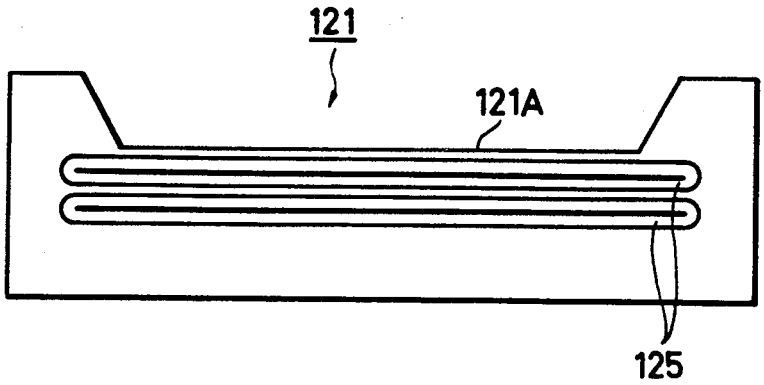
FIG. 9A is a plan view of a sheet holding plate of a recording apparatus according to an eighth embodiment of the present invention.
Figure 9B:
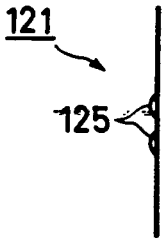
FIG. 9B is an end view of the sheet holding plate of FIG. 9A.
Figure 10:
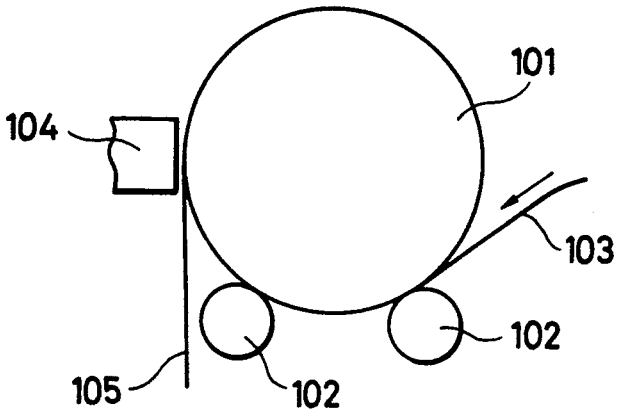
FIG. 10 PRIOR ART
Figure 11:
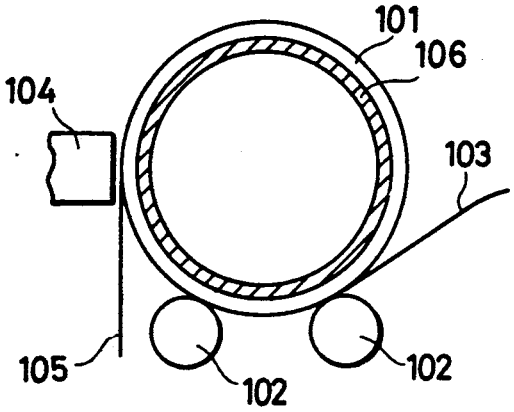
FIG. 11 PRIOR ART
Figure 12:
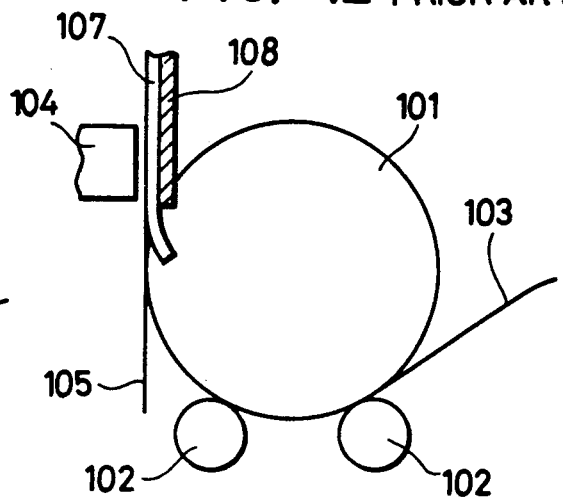
FIG. 12 PRIOR ART
Figure 13:
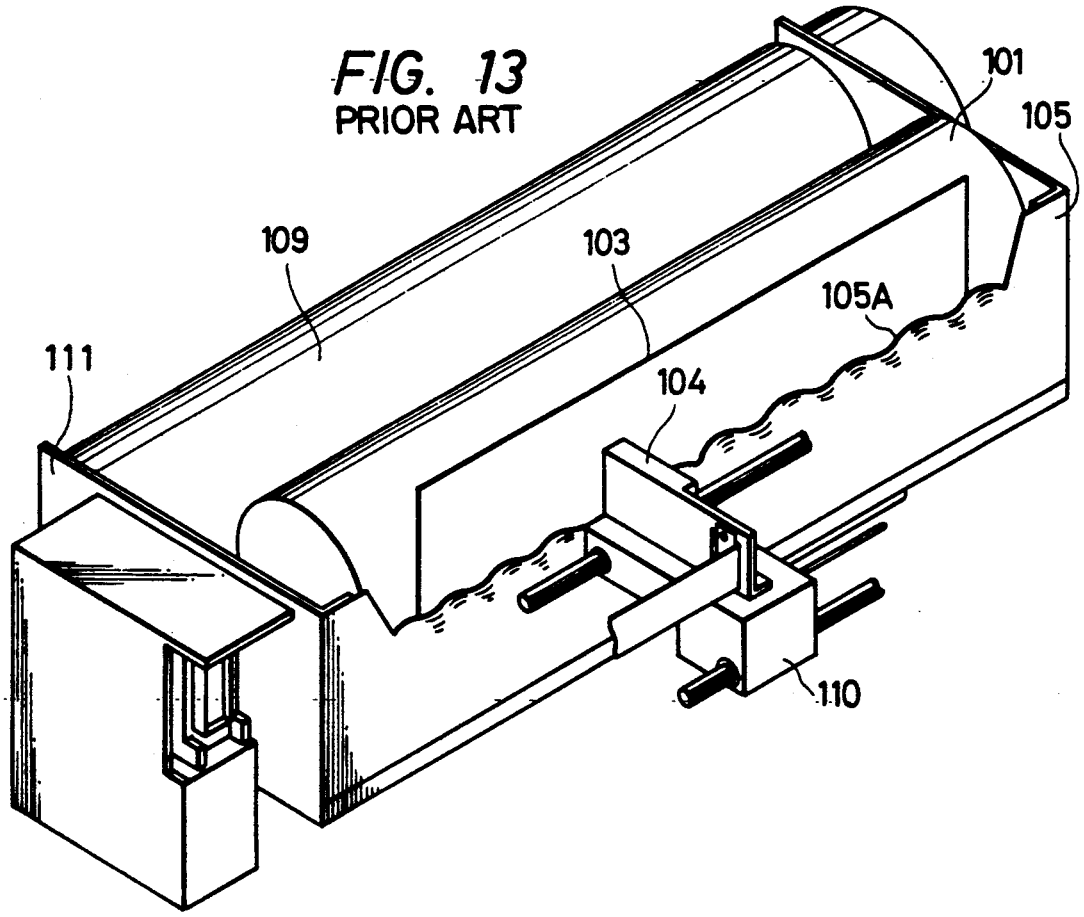
FIG. 13 PRIOR ART

FIGS. 9A and 9B show an eighth embodiment of the present invention, wherein a sheet holding plate 121 has one or more elongated projections or beads 125 smoothly protruded from a surface of the sheet holding plate and positioned parallel to an edge portion 121A of the plate. With this construction, the same effect as those in the embodiments of FIGS. 7 and 8 can be obtained. Further, in this embodiment, since the spring rate of the sheet holding plate 121 is larger, even a thicker recording medium such as an envelope and a thick paper can be positively pressed against the platen. In this embodiment, although the elongated beads 125 have been explained, the configuration and the number of these projections 125 are not limited to the illustrated ones, and any projection or projections can be used so far as it protrudes smoothly from the surface of the sheet holding plate and does not prevent the advance movement of the recording medium.

Furthermore, it should be noted that the present invention is not limited to the ink jet printer or wire dot printer. For example, the present invention can be widely adapted to a copying machine and other machines having a fixing means including a heat source and means for holding a heated sheet and the like, to effectively eliminate the thermal distortion of the sheet holding plate due to an uneven temperature distribution thereon.

We claim:

1. A printer comprising:

ink jet recording means for recording on a recording sheet;

means for providing a conveyance route for conveying the recording sheet through a recording area where said recording means is opposed to the recording sheet and records on the recording sheet, said means comprising a heating member for contacting the recording sheet to heat the recording sheet; and a press plate, disposed upstream of the recording area with respect to the conveying route, for pressing the recording sheet to said heating member, said press plate having a portion opposed to said heating member and a plurality of spaced apart slots spaced apart from each other in a direction perpendicular to a conveying direction of the recording sheet.

2. A printer according to claim 1, wherein said press plate has spring characteristics and contacts said heating member.

3. A printer according to claim 1, wherein said providing means further comprises a conveying member for discharging the recording sheet from the printer provided downstream of said recording area with respect to said conveying direction and wherein said heating member extends to a position opposed to said conveying member.

4. A printer according to claim 1, further comprising suction means for adhering the recording sheet to said heating member and wherein said suction means applies a suction force on a reverse side of said heating member with respect to a conveying surface of the recording sheet.

5. A printer according to claim 1, wherein said plurality of slots of said press plate are provided on a side end of said press plate on the upstream portion of said press plate with respect to said conveying direction and partially separate said side end from the rest of said press plate.

6. A printer according to claim 1, wherein said heating member has a temperature ranging from 40° C. to 100° C.

7. A printer according to claim 1, wherein said heating member has a temperature ranging from 30° C. to 150° C. and wherein said recording means includes an ink jet recording head.

8. A printer according to claim 7, wherein said providing means further comprises a conveying member for discharging the recording sheet from the printers provided downstream of the recording area with respect to said conveying direction and wherein said heating member extends to a position opposed to said conveying member.

9. A printer according to claim 1, wherein said plurality of slots of said press plate are provided on a side end of said press plate on the downstream portion of said press plate with respect to said conveying direction and partially separate from said side end from the rest of said press plate.

10. A printer according to claim 9, wherein the length of said plurality of slots is half the width of said press plate with respect to said conveying direction.

11. A printer according to claim 9, wherein said press plate has spring characteristics and contacts said heating member.

12. A printer according to claim 9, wherein said providing means further comprises a conveying member for discharging the recording sheet from said printer provided downstream of said recording area with respect to said conveying direction and said heating member extends to a position opposed to said conveying member.

13. An ink jet recording apparatus for recording by infiltrating ink into a recording sheet or fixing ink through the evaporation of an ink solvent, said apparatus comprising:

an ink jet recording head for ejecting ink onto the recording sheet along a scanning direction across the width of the recording sheet at a recording area of said apparatus where said recording head is opposed to the recording sheet;

a heating member extending both upstream and downstream with respect to said recording area and a conveying direction of the recording sheet, wherein said heating member contacts the recording sheet to assist in fixation of the ink;

a press plate, disposed upstream of said recording area with respect to a conveying route of the recording sheet, for pressing the recording sheet against said heating member, said press plate having a portion opposed to said heating member and a plurality of slots spaced apart from each other with respect to the scanning direction; and a conveying member for discharging the recording sheet from said apparatus provided downstream of said recording area with respect to the conveying direction and wherein said heating member extends to a position opposed to said conveying member.

* * * * *

UNITED STATES PATENT AND TRADEMARK OFFICE

CERTIFICATE OF CORRECTION

PATENT NO. : 5,005,025

DATED : April 2, 1991

INVENTOR(S) : MIYAKAWA ET AL.

It is certified that error appears in the above-identified patent and that said Letters Patent is hereby corrected as shown below:

On the title page:

AT [56] REFERENCES CITED

U.S. PATENT DOCUMENTS,
"2,664,988 2/1954 Metzner et al." should read
--2,664,988 1/1954 Metzner et al.

FOREIGN PATENT DOCUMENTS,
"2717119 10/1977 Fed. Rep. of Germany" should read
--2717119 10/1978 Fed. Rep. of Germany--.

COLUMN 2

Line 11, "efficiencY" should read --efficiency--.

Signed and Sealed this

Ninth Day of March, 1993

*Attest:*

STEPHEN G. KUNIN

*Attesting Officer*

*Acting Commissioner of Patents and Trademarks*